US011038312B2

(12) United States Patent
Strunk et al.

(10) Patent No.: US 11,038,312 B2
(45) Date of Patent: Jun. 15, 2021

(54) METHOD FOR CONNECTING AN ALUMINUM ELECTRICAL WIRE WITH AN ALUMINUM TUBE

(71) Applicant: Strunk Connect automated solutions GmbH & Co. KG, Kirchen (DE)

(72) Inventors: Olaf Strunk, Kirchen-Freusburg (DE); Nico Langberg, Neustrelitz (DE)

(73) Assignee: Strunk Connect automated solutions GmbH & Co. KG, Kirchen (DE)

( * ) Notice: Subject to any disclaimer, the term of this patent is extended or adjusted under 35 U.S.C. 154(b) by 242 days.

(21) Appl. No.: 16/125,836

(22) Filed: Sep. 10, 2018

(65) Prior Publication Data

US 2019/0081446 A1 Mar. 14, 2019

(30) Foreign Application Priority Data

Sep. 11, 2017 (DE) ..... 102017215970.7

(51) Int. Cl.

| | |
|---|---|
| ***H01R 43/048*** | (2006.01) |
| ***H01R 43/02*** | (2006.01) |
| ***H01R 4/18*** | (2006.01) |
| ***H01R 4/62*** | (2006.01) |

(52) U.S. Cl.

CPC ..... *H01R 43/048* (2013.01); *H01R 4/183* (2013.01); *H01R 4/187* (2013.01); *H01R 4/625* (2013.01); *H01R 43/0214* (2013.01); *H01R 2201/26* (2013.01)

(58) Field of Classification Search

CPC ..... H01R 2201/26; H01R 43/0214; H01R 43/048; H01R 4/183; H01R 4/187; H01R 4/625

See application file for complete search history.

(56) References Cited

U.S. PATENT DOCUMENTS 2,815,497 A * 12/1957 Redslob ..... H01R 4/62 439/203
3,626,363 A * 12/1971 McIver ..... H01R 43/0585 439/880
3,717,842 A 2/1973 Douglas
(Continued)

FOREIGN PATENT DOCUMENTS

CN 104541408 A 4/2015
CN 106207499 A 12/2016
(Continued)

*Primary Examiner* — Minh N Trinh
(74) *Attorney, Agent, or Firm* — Smartpat PLC

(57) ABSTRACT

A method for connecting an electrical cable having at least one wire made of aluminum or an aluminum alloy to a connector element includes the following steps: Inserting a stripped portion at an end of the electrical cable into a tube of the connector element. Crimping the tube where an end portion of the electrical cable is arranged so that a relative motion between the tube and the electrical cable is prevented. Crimping the tube where a second portion of the electrical cable is arranged, the second portion being further from the end of the electrical cable than the end portion, such that a change of the cross section and an elongation of the least one wire at the second portion of the electrical cable is caused. Resistance welding the tube to the at least one wire at the second portion of the electrical cable.

8 Claims, 2 Drawing Sheets

(56) References Cited

U.S. PATENT DOCUMENTS

| | | | | | |
|---|---|---|---|---|---|
| 3,842,487 | A * | 10/1974 | Hartz | H01R 4/187 228/116 |
| 4,208,788 | A * | 6/1980 | Siden | H01R 4/72 174/84 C |
| 4,551,364 | A * | 11/1985 | Davies | B29C 61/025 428/122 |
| 5,278,354 | A * | 1/1994 | Lhomme | H01R 4/72 174/84 C |
| 6,538,203 | B1 * | 3/2003 | Nolle | H01R 4/62 174/84 C |
| 6,658,735 | B2 * | 12/2003 | Ito | H01R 4/183 174/84 C |
| 8,350,155 | B2 * | 1/2013 | Kobayashi | H01R 4/186 174/84 R |
| 9,196,971 | B2 * | 11/2015 | Gery | H01R 4/203 |
| 9,444,212 | B2 | 9/2016 | Tachibana et al. | |
| 2001/0052420 | A1 * | 12/2001 | Ito | H01R 4/183 174/84 C |
| 2004/0029454 | A1 | 2/2004 | Onuma et al. | |
| 2008/0081499 | A1 | 4/2008 | Sumi et al. | |
| 2012/0324727 | A1 | 12/2012 | Seifert et al. | |
| 2013/0118804 | A1 | 5/2013 | Liegl et al. | |
| 2015/0140874 | A1 | 5/2015 | Sakaguchi | |
| 2019/0081446 | A1 * | 3/2019 | Strunk | H01R 43/048 |

FOREIGN PATENT DOCUMENTS

| | | | |
|---|---|---|---|
| CN | 206353610 | U | 7/2017 |
| DE | 102004063056 | A1 | 7/2006 |
| DE | 102007020210 | A1 | 12/2007 |
| DE | 102010038465 | A1 | 2/2012 |
| EP | 2362491 | B1 | 10/2017 |
| FR | 2501923 | A1 | 9/1982 |
| JP | 2003338330 | A | 11/2003 |
| JP | 2004071372 | A | 3/2004 |
| JP | 2006190662 | A | 7/2006 |

* cited by examiner

METHOD FOR CONNECTING AN ALUMINUM ELECTRICAL WIRE WITH AN ALUMINUM TUBE

TECHNICAL FIELD

The disclosure relates to a method for connecting an aluminum electrical wire having at least one strand made of aluminum or an aluminum alloy with a connector element having a tube or socket made of aluminum or the aluminum alloy.

BACKGROUND

Copper and copper alloys are known to be used in electrical wiring, in particular in motor vehicles. However, copper and copper alloys are relatively heavy. In order to save weight and fuel cost the use aluminum wires, which are equipped with connector elements made of other materials, is known, for example from European Patent EP 2362491 B1.

Electrical connections are known in motor vehicles, in which a connector element is connected by e.g. crimping and/or soldering to a cable. This type of connection, which is associated with some resistance, is generally acceptable for many applications. However, when used in electrical connections for high currents or used with connections having large cross sections, e.g. in automotive high voltage applications such as in electric vehicles, which continuously or alternatingly conduct high currents, the aforementioned resistance leads to unacceptable heating of the connection between the connector element and the electrical cable.

Therefore, the above-mentioned EP 2362491 B1 proposes a subsequent welding step in addition to a crimping step.

When crimping aluminum conductors with connector elements made of another material, however, problems arise caused by different thermal expansion coefficients of the materials used. According to EP 2362491 B1 those problems are to be mitigated by use of internal recesses in the crimping portion of the connector element, which are difficult to manufacture.

Further problems arise in the processing of aluminum, as aluminum is usually surrounded by an oxide layer. To weld the oxide-covered aluminum, temperatures of over 1500° C. have to be applied in order to melt the oxide layer. Since aluminum itself melts at about 660° C., use of sufficiently high temperatures to melt the oxide layer cause the aluminum core to evaporate, so that no useful weld joint can be formed.

For this reason, EP 2362491 B1 suggests to first perform a crimping operation in which the oxide layer is at least partially broken by crushing the aluminum wire.

This breakage may work for smaller wires or their strands. However, in combination with thicker electrical cables suitable for power supply in automobiles this partial breaking of the oxide layers is not sufficient to produce a reasonably acceptable weld.

SUMMARY

It is an object of the present disclosure to provide a method by means of which an electrical cable can be more completely welded to a connector element.

To achieve the object, it is proposed that first an end of the electric cable is stripped. The stripped portion of the electric cable is inserted into a tube of a connector element. The connector element may be e.g. be a terminal, a lug, or a splice. The tube is crimped in a first area in which an end portion of the stripped portion of the electric cable is located in such a way that at least one wire in the tube is secured so that a relative movement between the tube and the at least one wire is prevented. Then the tube is crimped a second time in a second area which is located farther from the end of the stripped electric cable than the first area. Subsequently, the at least one wire is welded to the tube by resistance welding in the area of the second crimp.

It is possible to use insulated wires, e.g. paint insulated wires, which do not necessarily need to be stripped, because the insulation evaporates during the subsequent welding step.

By the first crimping operation is achieved that the at least one wire of any cross section cannot move relative to the tube. When using a stranded wire, the first crimping operation prevents relative movement of the strands relative to the tube and relative to each other. Since the strands at the other end of the electric cable are still within an insulation cover it can be expected that the strand do not move relative to one another there either. Of course, two crimping operations can preferably be carried out simultaneously, and the second crimping operation can be placed between the two first crimping positions. Thus, the at least one wire, usually the strands of a stranded wire, can be secured for the second crimping step such that essentially no movement of the strands relative to one another is possible.

When the second crimping operation is performed the at least one wire of any cross section respectively the individual strands of the stranded wire can only be compressed and elongated. This elongation applies to all strands of the stranded wire. This causes the oxide layer to burst at all strands of the stranded wire, so that all of the strands of the stranded wire are free of the oxide layer. The subsequent welding process can then take place at temperatures that are common for aluminum. Since all strands of the aluminum wire and the tube are free of the oxide layer, very good penetration welding is effected, and any remaining insulation evaporates at these temperatures.

Although the second crimping step could be carried out by a crimping tool and subsequently the welding electrodes could be attached to the location of the second crimp, it has proven advantageous that the second crimping operation is directly performed by at least two welding electrodes. Thereby, a separate compression tool for the second crimping step is not necessary, and the welding electrodes can cost effectively be used to perform the second compression step.

If a single strand wire, for example, a thin lead wire of an electrical winding is to be welded to the tube or sleeve, an optimal elongation, and thus an optimal removal of the oxide layer can still be achieved when the end of the wire is firmly held in the area of the first crimp.

It is advantageous if the second crimping operation and the welding take place simultaneously. It is advisable to carry out the welding at the end of the second crimping operation.

Suitably, the first crimping operation is effected by a compression tool. The compression tool should be formed at least in two parts and the two or more parts of the compression tool should completely surround the tube after the crimping operation.

It is of course possible to perform the first crimping operation, thereafter move the electric cable, and then carry out the second crimping operation. It has however proven beneficial to keep the compression tool closed while the second crimping operation is performed, that is, to not move the electric cable until after it has been crimped at a second location and to open the compression tool only after the welding is complete. This eliminates the need for a mechanism to move the electric cable at the compression- and welding device. However, a second drive mechanism is needed for the second crimping tool. Still, the two crimping operations can be performed significantly faster one after another if the crimping tools are arranged at two adjacent locations in the welding machine.

It has been found beneficial to superimpose an axial component along the at least one wire away from the location of the first crimp to the substantially radially acting second crimping process.

Even a very small movement in the axial direction improves the elongation of at least one wire, and causes an even better removal of the oxide layer.

BRIEF DESCRIPTION OF THE DRAWINGS

The method is further explained by reference to three drawings.

DETAILED DESCRIPTION

Figure 1:
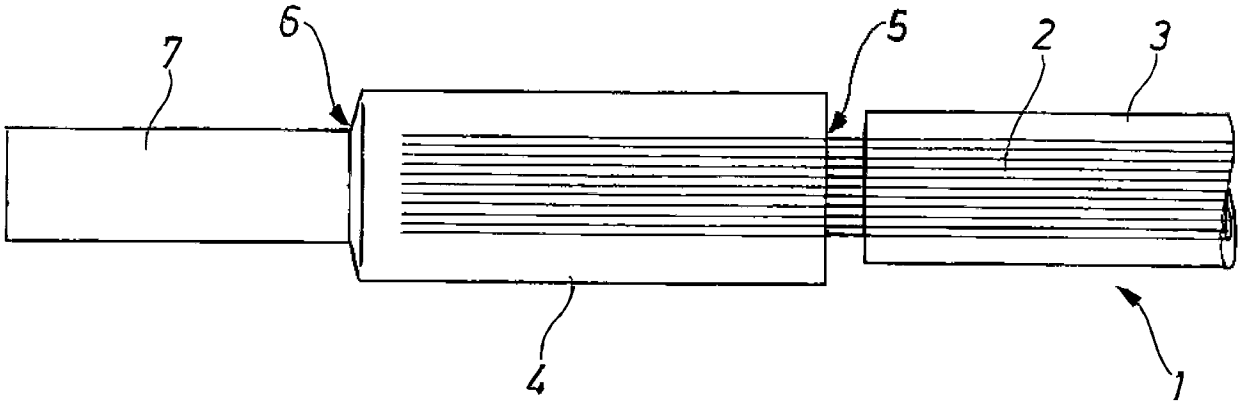
FIG. 1 shows an electrical cable with a connector element before crimping and welding.

Referring to FIG. 1, an electrical cable 1 includes a stranded aluminum wire 2 which is surrounded by an insulation 3. The individual strands of the stranded aluminum wire 2 are illustrated. A tube 4 is shown having a first open end 5 into which the stranded aluminum wire 2 of a stripped end of the electrical cable 1 has been inserted. A connector element 7 is formed at a second end 6 of the tube 4.

Figure 2:
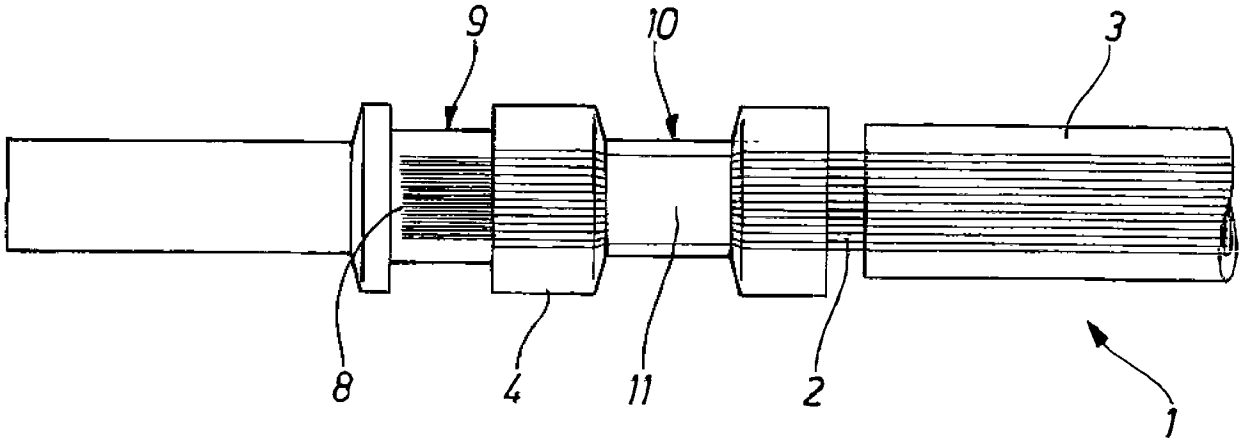
FIG. 2 shows the electrical cable with the connector element after having been crimped and welded.

Referring to FIG. 2, the electrical cable 1 is shown with the connector element 7 after the crimping and welding process has been completed. A first crimped area 9 is shown in an end region 8 of the stranded aluminum wire 2. At the first crimped area 9 the stranded aluminum wire 2 has been compressed by the tube 4 such that the individual strands of the stranded aluminum wire 2 can no longer move relative to one another. Adjacent to the first crimped area 9 a second crimped area 10 is shown in direction towards the insulation 3. The stranded aluminum wire 2 has been compressed and elongated in the second crimped area 10 due to its strands being unable to move relative to each other at the first crimped area 9 and in the area covered by the insulation 3. This has caused the oxide layer on almost all strands of the stranded aluminum wire 2 to break. By crimping also the oxide layer on the inside of the tube 4 has been broken.

By a subsequent welding process the stranded aluminum wire 2 has been welded over a large area to the pipe 4 as illustrated by the weld nugget 11.

Figure 3:
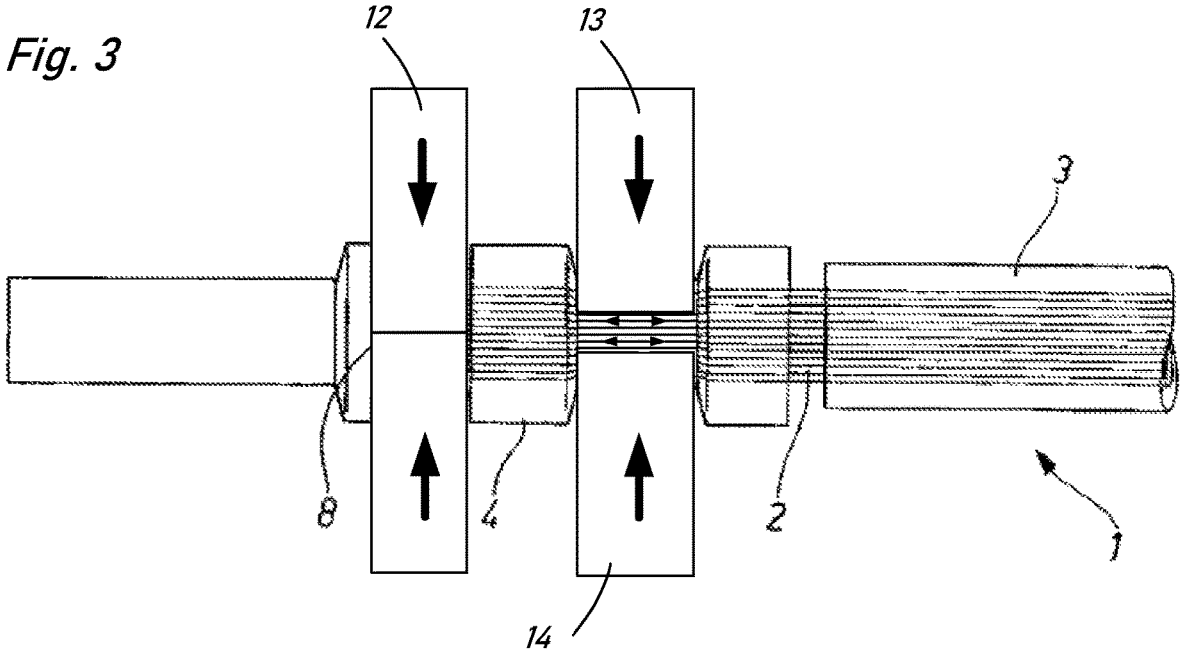
FIG. 3 shows a compression tool in combination with the electrical cable as in FIG. 2.

FIG. 3 shows a compression tool 12 to perform the first crimping. The compression tool 12 comprises two parts that completely surround the tube during the crimping operation. The second crimping operation is performed by two welding electrodes 13, 14. A separate compression tool for the second crimping step is not necessary, and the welding electrodes can cost effectively be used to perform the second compression step, functioning as a second compression tool.

The invention claimed is:

1. A method, comprising:

inserting a stripped portion at an end of an electrical cable having at least one wire made of aluminum or an aluminum alloy into a tube of a connector element made of aluminum or the aluminum alloy;

arranging an end portion of the electrical cable in a first area of the tube;

arranging a second portion of the electrical cable in a second area of the tube, the second portion being further from the end of the electrical cable than the end portion;

crimping the tube in the first area such that a relative motion between the tube and the at least one wire of the electrical cable is prevented;

crimping the tube in the second area and causing an elongation of the least one wire at the second portion of the electrical cable; and resistance welding the tube to the at least one wire at the second portion of the electrical cable.

2. The method as in claim 1, further comprising:

providing a first crimping tool; and providing a second crimping tool with two welding electrodes, wherein crimping the tube in the first area is effected by the first crimping tool and wherein crimping the tube in the second area effected by the two welding electrodes.

3. The method as in claim 1, wherein crimping the tube in the second area and resistance welding the tube to the at least one wire are simultaneous.

4. The method as in claim 1, wherein crimping the tube in the first area includes crimping the tube in the first area with a compression tool.

5. The method as in claim 4, wherein crimping the tube in the first area with the compression tool comprises causing at least two parts of the compression tool to completely surround the tube.

6. The method as in claim 4, further comprising:

keeping the compression tool closed while crimping the tube in the second area and opening the compression tool only after resistance welding the tube to the at least one wire.

7. The method as in claim 1, further comprising:

providing a first crimping tool; and providing a second crimping tool, wherein crimping the tube in the first area is effected by the first crimping tool and wherein crimping the tube in the second area comprises axially moving the second crimping tool along the at least one wire away from the end portion of the electrical cable.

8. The method as in claim 1, further comprising:

causing an oxide layer on the at least one wire to break.

* * * * *